US005129229A

United States Patent [19]

Nakamura et al.

[11] Patent Number: 5,129,229

[45] Date of Patent: Jul. 14, 1992

[54] HYDRAULIC DRIVE SYSTEM FOR CIVIL-ENGINEERING AND CONSTRUCTION MACHINE

[75] Inventors: Kazunori Nakamura, Ibaraki; Hideaki Tanaka, Tsuchiura, both of Japan

[73] Assignee: Hitachi Construction Machinery Co., Ltd., Tokyo, Japan

[21] Appl. No.: 716,965

[22] Filed: Jun. 18, 1991

[30] Foreign Application Priority Data

Jun. 19, 1990 [JP] Japan ..... 2-158744

[51] Int. Cl.[5] ..... F15B 13/08

[52] U.S. Cl. ..... 60/452; 60/427; 91/451; 91/518; 137/596.13

[58] Field of Search ..... 60/427, 452; 91/451, 91/518; 137/596.13

[56] References Cited

U.S. PATENT DOCUMENTS 3,976,097 8/1976 Brakel .
4,153,075 5/1979 Budzich .
4,617,854 10/1986 Kropp .
4,727,793 3/1988 Hall .

FOREIGN PATENT DOCUMENTS 3212947 10/1983 Fed. Rep. of Germany .
3422165 12/1984 Fed. Rep. of Germany .
3425304 1/1986 Fed. Rep. of Germany .

OTHER PUBLICATIONS

Olhydraulik und Pneumatik, H. Lodige, vol. 33, No. 9, 1988, pp. 608–613, "Optimierung eines LS Wegeventil-systems".

*Primary Examiner*—Gerald A. Michalsky
*Attorney, Agent, or Firm*—Fay, Sharpe, Beall, Fagan, Minnich & McKee

[57] ABSTRACT

A hydraulic drive system for a civil-engineering and construction machine, includes an unloading valve connected to a discharge line of a hydraulic pump for relieving a hydraulic fluid from the hydraulic pump to a tank when a differential pressure between a delivery pressure of the hydraulic pump and a load pressure of an actuator exceeds a first predetermined value, for controlling the differential pressure. The unloading valve has a spool, a first receiving chamber arranged adjacent to one end of the spool, and a second pressure receiving chamber arranged adjacent to the other end of the spool, the delivery pressure of the hydraulic pump being introduced into the first pressure receiving chamber and the load pressure of the hydraulic actuator being introduced into the second pressure receiving chamber. The unloading valve is provided with a restrictive communication path for selectively communicating the first pressure receiving chamber and the second pressure receiving chamber with each other, whereby when a phase deviation exists between the delivery pressure $P_s$ of the hydraulic pump and the maximum load pressure $P_L$ transmitted to the unloading valve as signal pressures, oscillation of the unloading valve is prevented.

21 Claims, 7 Drawing Sheets

HYDRAULIC DRIVE SYSTEM FOR CIVIL-ENGINEERING AND CONSTRUCTION MACHINE

BACKGROUND OF THE INVENTION

The present invention relates to hydraulic drive systems of the load sensing control type for civilengineering and construction machines such as hydraulic excavators or the like and, more particularly, to a hydraulic drive system for a civil-engineering and construction machine and to an unloading valve used in the hydraulic drive system, in which the unloading valve is driven in response to a differential pressure between a delivery pressure of a hydraulic pump and a load pressure of an actuator to relieve hydraulic fluid of the hydraulic pump to a tank.

A hydraulic drive system used in a civilengineering and construction machine such as a hydraulic excavator, a hydraulic crane or the like comprises a hydraulic source including a hydraulic pump, a hydraulic actuator driven by hydraulic fluid supplied from the hydraulic source, and a directional control valve for controlling flow of the hydraulic fluid supplied from the hydraulic source to the hydraulic actuator. As the hydraulic drive system, there is a type in which a delivery pressure of the hydraulic pump is so controlled as to be raised by a predetermined value more than a load pressure of the hydraulic actuator. As a representative example of the hydraulic drive system, as disclosed, for example, in U.S. Pat. No. 4,617,854 (corresponding to DE, Al, 3422165), there is a load sensing control (LS control) in which a delivery amount of the hydraulic pump is so controlled as to be raised by a predetermined value more than the load pressure of the hydraulic actuator. In this control system, normally, an unloading valve is connected to a discharge line of the hydraulic pump. The unloading valve has mainly the following two functions: (1) when the directional control valve is in a neutral position and a delivery flow rate of the hydraulic pump is at a minimum flow rate, the unloading valve operates so as to return the pump delivery flow rate to a tank to maintain the delivery pressure of the hydraulic pump at a predetermined value, and (2) when a differential pressure (LS differential pressure) between the delivery pressure of the hydraulic pump and the load pressure of the actuator rises transiently in such a case as when the directional control valve is abruptly returned to the neutral position, the unloading valve operates so as to partially return the pump delivery flow rate to the tank to limit a rise in the LS differential pressure.

Further, in the above-described control system, the minimum delivery flow rate of the hydraulic pump is set to a value larger than a demanded flow rate at the time when the directional control valve is operated by a relatively minute stroke. When the directional control valve is operated by the minute stroke with the intention of minute operation of a working member or element, a part of the pump delivery flow rate is supplied to the actuator, while the remaining delivery flow rate is returned to the tank through the unloading valve.

Furthermore, as another system in which the delivery pressure of the hydraulic pump is so controlled as to be raised by a predetermined value more than the load pressure of the hydraulic actuator, there is a system as disclosed in, for example, U.S. Pat. No. 3,976,097 in which a hydraulic pump of a fixed displacement type is used as the above-described hydraulic pump, and a differential pressure between the pump delivery pressure and the load pressure of the actuator is controlled only by an action of an unloading valve connected to a discharge line. In this control system, when the directional control valve is in the neutral position, a full amount of the pump delivery flow rate (fixed) is returned to the tank through the unloading valve, while, when the directional control valve is operated to the maximum stroke, a full amount of the pump delivery flow rate is supplied to the actuator. When the directional control valve is in an intermediate position between the neutral position and the maximum stroke, a part of the pump delivery flow rate is returned to the tank through the unloading valve in accordance with the stroke position. In the operation at the intermediate position, since the unloading valve normally has a metering characteristic, if a flow rate (a leak amount) returned to the tank increases, the differential pressure (LS differential pressure) between the delivery pressure of the hydraulic pump and the load pressure of the actuator also increases.

However, the conventional load-sensing hydraulic drive systems have the following problems.

In the hydraulic drive systems comprising the above-described unloading valve, a line extending between the unloading valve and the pump discharge line and a line extending between the unloading valve and an actuator load-pressure takeout circuit are different in length from each other and, generally, the latter is longer than the former. That is, the latter line volume is larger than the former line volume. Moreover, the hydraulic fluid as a working fluid has compressibility. For this reason, when the load pressure and the pump delivery pressure vary due to change in the magnitude of the load, change in opening of the directional control valve and the like, a deviation or lag occurs in timing at which these changes are transmitted to the unloading valve as signal pressures, and a delay or lag in transmission, that is, a deviation or stagger in phase occurs between the load pressure and the delivery pressure of the hydraulic pump.

Further, as described above, during operation, the unloading valve relieves a part of the pump delivery flow rate to the tank except that the directional control valve is in the neutral position. Under this operating condition, however, the unloading valve is under a partially open condition, and the LS differential pressure varies depending upon the leak amount of the tank. For this reason, when a phase deviation of the signal pressure as described above occurs when the unloading valve is under such partially open condition, change in position of an unloading-valve spool due to the phase deviation of the signal pressure and change of the LS differential pressure due to the change in position of the spool of the unloading valve interfere with each other. Thus, oscillation occurs in the unloading valve.

When oscillation occurs in the unloading valve, the flow rate supplied to the actuator varies or fluctuates so that operability is reduced. Further, oscillation of a piping system due to oscillation of the unloading valve causes a control lever of the directional control valve to oscillate. Thus, an operator tends to be tired.

In the LS control system in which the pump delivery flow rate is so controlled as to maintain the LS differential pressure at a predetermined value, a part of the pump delivery flow rate is returned to the tank through the unloading valve when the directional control valve operates by the minute stroke, as described above, so that the unloading valve is brought to the partially open condition. Accordingly, in this control system, the unloading valve is liable to oscillate when a minute flow rate is supplied to the actuator. Thus, minute operation of the working element is apt to become difficult.

In view of the above-described circumstances of the prior art, an object of the invention is to provide a hydraulic drive system for a civil-engineering and construction machine and an unloading valve for use in the hydraulic drive system, which are capable of preventing oscillation due to a phase deviation between a load pressure and a delivery pressure of a hydraulic pump which are transmitted to the unloading valve as signal pressures.

SUMMARY OF THE INVENTION

In order to achieve the above-described object, according to the invention, there is provided a hydraulic drive system for a civil-engineering and construction machine, comprising a hydraulic source including a hydraulic pump, a hydraulic actuator driven by a hydraulic fluid supplied from the hydraulic source, a directional control valve for controlling a flow of the hydraulic fluid supplied from the hydraulic source to the hydraulic actuator, and an unloading valve connected to a discharge line of the hydraulic pump for relieving the hydraulic fluid from the hydraulic pump to a tank when a differential pressure between a delivery pressure of the hydraulic pump and a load pressure of the actuator exceeds a first predetermined value, for controlling the differential pressure. The unloading valve includes a spool, a first pressure receiving chamber arranged adjacent to one end of the spool, and a second pressure receiving chamber arranged adjacent to the other end of the spool, the delivery pressure of the hydraulic pump being introduced into the first pressure receiving chamber, and the load pressure of the hydraulic actuator being introduced into the second pressure receiving chamber. The unloading valve includes restrictive communication means for selectively communicating the first pressure receiving chamber and the second pressure receiving chamber with each other.

Further, in order to achieve the aforesaid object, according to the invention, there is provided an unloading valve for use in a hydraulic drive system for a civil-engineering and construction machine, the hydraulic drive system comprising a hydraulic source including a hydraulic pump, a hydraulic actuator driven by a hydraulic fluid supplied from the hydraulic source, and a directional control valve for controlling a flow of the hydraulic fluid supplied from the hydraulic source to the hydraulic actuator. The unloading valve is connected to a discharge line of the hydraulic pump for relieving the hydraulic fluid from the hydraulic pump to a tank when a differential pressure between the delivery pressure of the hydraulic pump and the load pressure of the actuator exceeds a first predetermined value, for controlling the differential pressure. The unloading valve includes a spool, a first pressure receiving chamber arranged adjacent to one end of the spool, and a second pressure receiving chamber arranged adjacent to the other end of the spool, the delivery pressure being introduced into the first pressure receiving chamber and the load pressure of the hydraulic actuator being introduced into the second pressure receiving chamber. The unloading valve comprises restrictive communication means for selectively communicating the first pressure receiving chamber and the second pressure receiving chamber with each other.

In the invention constructed as described above, the restrictive communication means is so set as to communicate the first and second pressure receiving chambers with each other when the unloading valve is under the aforesaid partially open condition. With the setting made in this manner, when a phase deviation occurs between the load pressure and the pump delivery pressure transmitted to the unloading valve as signal pressures under the partially open condition of the unloading valve, the control pressure reaching first the unloading valve is transmitted to the corresponding pressure receiving chamber, and is also transmitted to the other pressure receiving chamber through the restrictive communication means. Thus, the differential pressure between both the pressure receiving chambers does not excessively increase. By such restraint of the differential pressure, operation of the spool of the unloading valve is stabilized. Thus, it is possible to prevent the unloading valve from oscillating due to a phase deviation between the delivery pressure and the load pressure as signal pressures.

Setting of the restrictive communication means is so specifically performed as to communicate the first pressure receiving chamber and the second pressure receiving chamber with each other when the differential pressure exceeds a second predetermined value larger than the first predetermined value. Furthermore, in a hydraulic drive system in which the hydraulic pump is of a variable displacement type, and in which the hydraulic source includes a regulator for controlling a delivery flow rate of the hydraulic pump such that a differential pressure between the delivery pressure of the hydraulic pump and a load pressure is maintained at a third predetermined value, setting of the restrictive communication means is made such that the first pressure receiving chamber and the second pressure receiving chamber communicate with each other when the differential pressure exceeds a fourth predetermined value larger than the first and second predetermined values.

Preferably, the restrictive communication means includes a passage through which the first pressure receiving chamber and the second pressure receiving chamber communicate with each other, and a restriction provided in the passage.

Further, the restrictive communication means may be provided within the spool, or may be provided in a housing forming a body of the unloading valve.

DESCRIPTION OF THE PREFERRED EMBODIMENTS

Embodiments of a hydraulic drive system for a civil-engineering and construction machine, according to the invention, will be described below with reference to the accompanying drawings.

First Embodiment

A first embodiment of the invention will first be described with reference to FIGS. 1 through 7.

Figure 1:
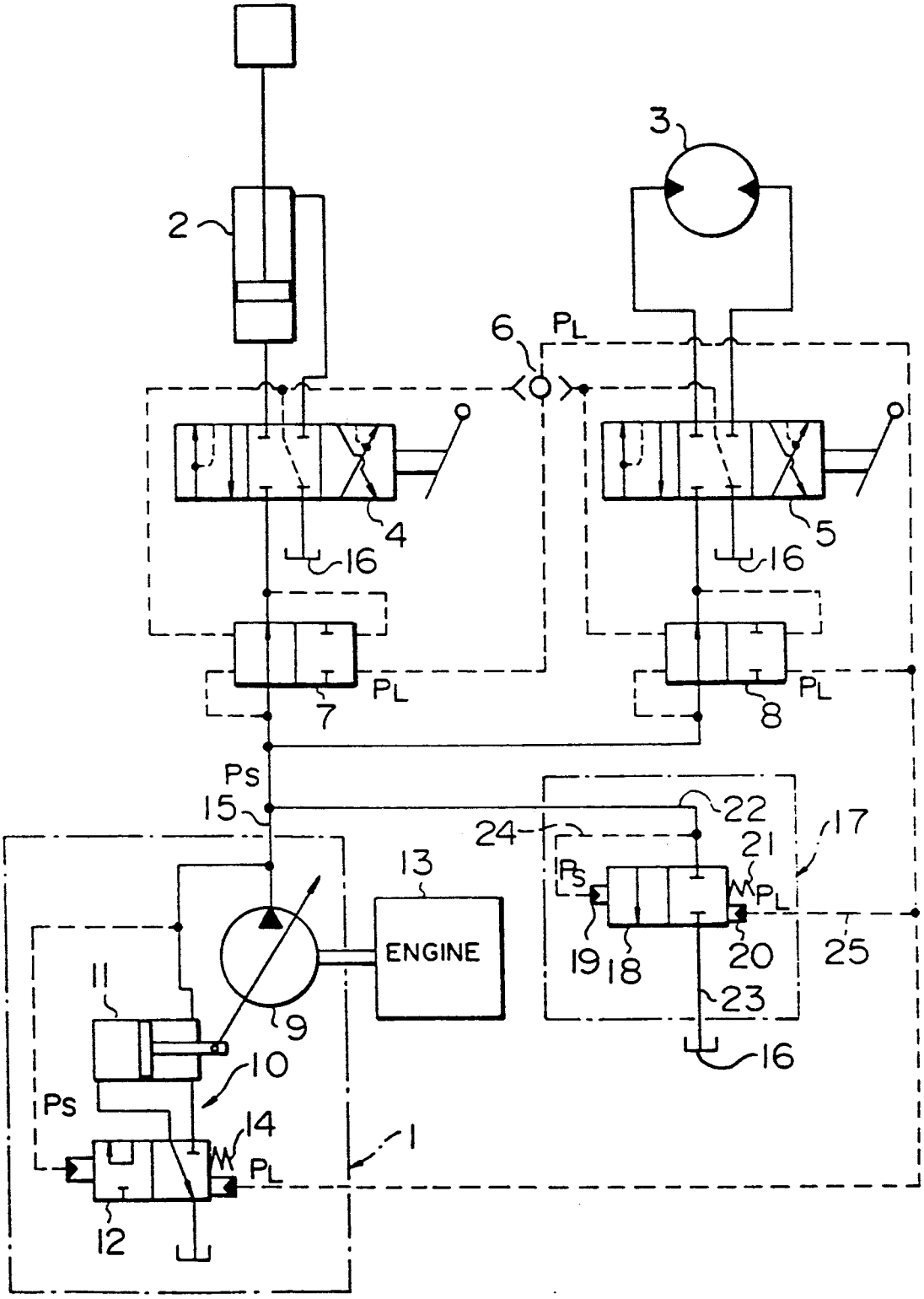
FIG. 1 is a schematic view showing a circuit arrangement of a hydraulic drive system for a civil-engineering and construction machine, according to a first embodiment of the invention.

Referring first to FIG. 1, there is shown a hydraulic drive system according to the present embodiment of the invention. The hydraulic drive system comprises a hydraulic source 1, hydraulic actuators, for example, a hydraulic cylinder 2 and a hydraulic motor 3 driven by a hydraulic fluid supplied from the hydraulic source 1, a directional control valve 4 for controlling a flow of the hydraulic fluid supplied from the hydraulic source 1 to the hydraulic cylinder 2, a directional control valve 5 for controlling a flow of the hydraulic fluid supplied from the hydraulic source 1 to the hydraulic motor 3, a shuttle valve 6 for taking out a load pressure on a higher side of load pressures of the actuators, that is, a maximum load pressure $P_L$, a pressure compensating valve 7 for controlling a differential pressure between an upstream pressure and a downstream pressure of the directional control valve 4, that is, a differential pressure across the directional control valve 4, and a pressure compensating valve 8 for controlling a differential pressure between an upstream pressure and a downstream pressure of the directional control valve 5, that is, a differential pressure across the directional control valve 5. The hydraulic source 1 includes a hydraulic pump 9 of a variable displacement type, and a regulator 10 for controlling a delivery flow rate of the hydraulic pump 9. The regulator 10 is provided with a control actuator 11 for controlling a displacement volume of the hydraulic pump 9, and a flow regulating valve 12 operative in response to a differential pressure $\Delta P_{LS}$ (hereinafter referred to as "LS differential pressure") between a delivery pressure $P_s$ of the hydraulic pump 9 and the maximum load pressure $P_L$ of the actuator, for controlling driving of the control actuator 11. The hydraulic pump 9 is driven by a prime mover 13, and the regulator 10 controls a delivery flow rate of the hydraulic pump 9 such that a force due to the LS differential pressure $\Delta P_{LS}$ balances with a force of a spring 14 of the flow regulating valve 12. The spring force of the spring 14 is set such that the LS differential pressure $\Delta P_{LS}$ is maintained at, for example, 15 Kg/cm$^2$. Further, the LS differential pressure $\Delta P_{LS}$ is loaded on the aforementioned pressure compensating valves 7 and 8 as a target compensating differential pressure, so that the pressure compensating valves 7 and 8 conduct pressure compensation such that the differential pressures across the respective directional control valves 4 and 5 are brought to the LS differential pressure $\Delta P_{LS}$.

Figure 2:
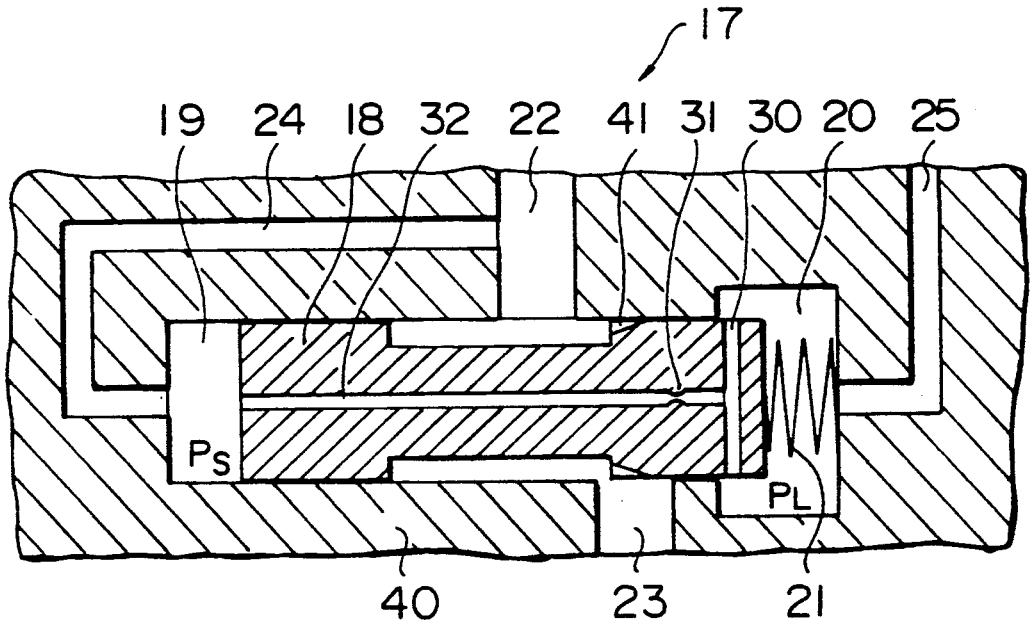
FIG. 2 is a cross-sectional view showing an arrangement of an unloading valve illustrated in FIG. 1.

An unloading valve 17 is arranged between a discharge line 15 of the hydraulic pump 9 and a tank 16. As shown in FIG. 2, the unloading valve 17 comprises a spool 18 housed for movement within a valve housing 40, a first pressure receiving chamber 19 arranged adjacent to one end face of the spool 18, the delivery pressure $P_s$ of the hydraulic pump 9 being introduced into the first pressure receiving chamber 19, a second pressure receiving chamber 20 arranged adjacent to the other end face of the spool 18, the maximum load pressure $P_L$ of the actuator being introduced into the second pressure receiving chamber 20, a spring 21 arranged within the second pressure receiving chamber 20 for biasing the spool 18 toward the first pressure receiving chamber 19, a passage 22 in communication with the discharge line 15 shown in FIG. 1, a passage 23 in communication with the tank 16, a passage 24 communicating the passage 22 with the first pressure receiving chamber 19, and a passage 25 through which the maximum load pressure $P_L$ is introduced into the second pressure receiving chamber 20. A plurality of notches 41, which cooperate with each other to form a variable restriction, are formed circumferentially in the spool 18 at a location between the passage 22 and the passage 23. The spring force of the spring 21 is set such that the pressure at which the unloading valve 17 begins to open, that is, a cracking pressure becomes 15 Kg/cm$^2$.

The unloading valve 17 is provided with restrictive communication means for selectively communicating the first pressure receiving chamber 19 into which the delivery pressure $P_s$ is introduced, and the second pressure receiving chamber 20 into which the maximum load pressure $P_L$ is introduced, with each other. In the embodiment, the restrictive communication means comprises a passage 30 formed radially through a portion of the spool 18 adjacent to the second pressure receiving chamber 20, and a passage 32 formed axially in the spool 18, the passage 32 having one end thereof opening to the first pressure receiving chamber 19 and the other end communicating with the aforesaid passage 30. A restriction 31 is provided in the passage 32. Locations of the open ends of the passage 30 are set such that when the spool 18 is moved to the right in FIG. 2 against the force of the spring 21 from the condition to interrupt the communication between the passage 22 and the passage 23 and prevent a leak amount Q to the tank 16 from occurring, the passage 30 opens to the second pressure receiving chamber 20 when the spool 18 is slightly moved in the right direction after the unloading valve 17 begins to open.

Figure 3:
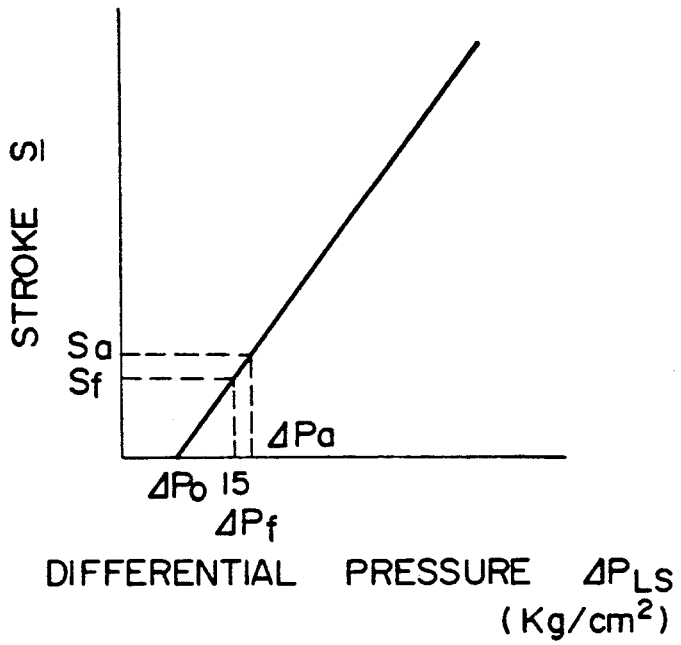
FIG. 3 is a characteristic view showing a relationship between an LS differential pressure and a stroke of the unloading valve illustrated in FIG. 2.
Figure 4:
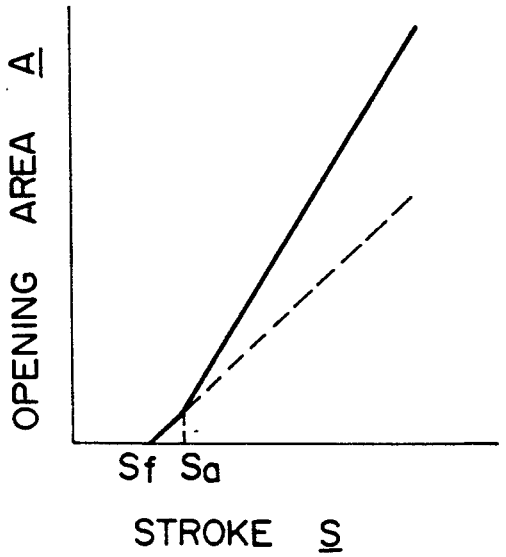
FIG. 4 is a characteristic view showing a relationship between the stroke and an opening area of the unloading valve illustrated in FIG. 2.
Figure 5:
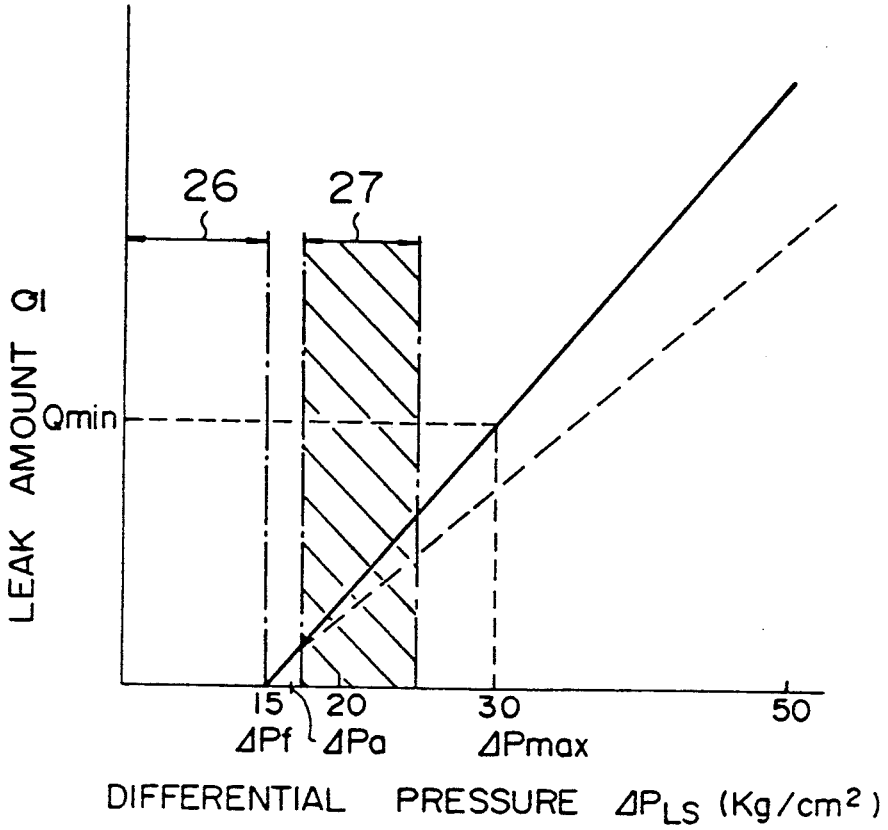
FIG. 5 is a characteristic view showing a relationship between the LS differential pressure and a leak amount of the unloading valve illustrated in FIG. 2.

A characteristic of the above-described unloading valve 17 is shown in FIGS. 3 through 5. FIG. 3 is a characteristic view showing a relationship between the differential pressure between the delivery pressure $P_s$ and the maximum load pressure $P_L$ acting upon the ends of the spool 18 of the unloading valve 17, that is, the LS differential pressure $\Delta P_{LS}$, and a stroke S of the spool 18. FIG. 4 is a characteristic view showing a relationship between the stroke S of the spool 18 and an opening area A thereof, while FIG. 5 is a characteristic view showing a relationship between the LS differential pressure $\Delta P_{LS}$ and an amount Q of leak to the tank 16.

In FIG. 3, $S_f$ indicates a stroke of the spool 18 at which the aforesaid unloading valve 17 begins to open, and $S_a$ indicates a stroke of the spool 18 at which the passage 30 opens to the second pressure receiving chamber 20. Further, $\Delta P_f$ indicates a differential pressure (15 Kg/cm$^2$) equivalent to the cracking pressure of the spring 21 as described above. When the LS differential pressure $\Delta P_{LS}$ acting upon the spool 18 is smaller than $\Delta P_o$, the spool 18 of the unloading valve 17 is held by the spring 21 at an initial closed position. As the LS differential pressure $\Delta P_{LS}$ is raised more than $\Delta P_o$, the stroke S of the spool 18 increases proportionally. Here, within such a range that the LS differential pressure is smaller than $\Delta P_f$, the stroke is less than $S_f$ so that the unloading valve 17 is closed. Accordingly, as shown in FIG. 4, the opening area A of the unloading valve 17 is 0 (zero) so that, as shown in FIG. 5, no leak amount Q to the tank 16 occurs. That is, under this condition, the entire amount of the pump delivery flow rate is supplied to the actuator. In FIG. 5, this region is designated by the reference numeral 26.

As the LS differential pressure $\Delta P_{LS}$ is raised more than $\Delta P_f$, the stroke S also increases more than $S_f$ so that the unloading valve 17 opens. Accordingly, as shown in FIG. 4, the opening area A of the unloading valve 17 also increases proportionally at a constant rate until the stroke S reaches $S_a$ so that, as shown in FIG. 5, the leak amount Q increases proportionally. Here, as the LS differential pressure is raised more than $\Delta P_a$, the stroke is raised more than $S_a$ as illustrated in FIG. 3 so that the passage 30 opens to the second pressure receiving chamber 20 as described previously. Since, under this condition, the two pressure receiving chambers 19 and 20 are brought to communicate with each other through the passages 30 and 32 and the restriction 31, the difference in pressure between the two pressure receiving chambers 19 and 20 is substantially reduced less than the LS differential pressure $\Delta P_{LS}$. Accordingly, if the increasing rate of the opening area A with respect to the stroke S has a characteristic identical with that at the time when the stroke is less than $S_a$ as indicated by the broken line in FIG. 4, the relationship between the LS differential pressure $\Delta P_{LS}$ and the leak amount Q is brought to one as indicated by the broken lines in FIG. 5, so that there is not obtained a linear characteristic in which the leak amount Q increases at a constant rate. In view of this, as indicated by the solid line in FIG. 4, as the stroke increases beyond $S_a$, the increasing rate of the opening area A with respect to the stroke S increases. The configuration of the notches 41 shown in FIG. 2 is so selected that there is obtained such a characteristic. By the fact that the relationship between the stroke S and the opening area A is set in this manner, the relationship between the LS differential pressure $\Delta P_{LS}$ and the leak amount Q becomes such that the leak amount Q increases proportionally at a constant rate as indicated by the solid line in FIG. 5. Thus, there is obtained the characteristic identical with that of the conventional unloading valve.

In connection with the above, a region 27 indicated by the oblique lines in FIG. 5 is an unstable region in which, as will be described later, when the directional control valve 4 or 5 is operated by a minute stroke whereby the LS differential pressure is controlled to a range of from 15 to 30 Kg/cm$^2$, oscillation is apt to occur in the unloading valve 17 by disturbance. The LS diffential pressure $\Delta P_a$ at which the passage 30 of the restrictive communication means opens to the second pressure receiving chamber 20, is set to be larger than 15 Kg/cm$^2$ that is the set differential pressure of the spring 14 of the regulator 10 and that is the cracking pressure of the unloading valve 17, but smaller than a lower limit of the unstable region 27.

The basic or fundamental operation of the hydraulic drive system constructed as described above is as follows.

First, when the directional control valves 4 and 5 are in their respective neutral positions, since the maximum load pressure $P_L$ given to the flow regulating valve 12 of the regulator 10 is the tank pressure, the flow regulating valve 12 is moved to the right in FIG. 1 by the delivery pressure $P_s$ against the force of the spring 14 to take the left-hand position, so that the variable-displacement hydraulic pump 9 is so controlled as to supply the minimum flow rate $Q_{min}$ by the difference in pressure receiving area in the control actuator 11. Further, the delivery pressure $P_s$ of the hydraulic pump is given to the first pressure receiving chamber 19 of the unloading valve 17, and the maximum load pressure $P_L$ of the actuator is given to the second pressure receiving chamber 20, so that the spool 18 of the unloading valve 17 is operated such that the force due to the differential pressure $\Delta P_{LS}$ between the delivery pressure $P_s$ and the maximum load pressure $P_L$ balances with the force of the spring 21. At this time, since the directional control valves 4 and 5 are in their respective neutral positions and the maximum load pressure $P_L$ is the tank pressure, the spool 18 is moved in the right-hand direction in FIG. 2 depending on the delivery pressure $P_s$ against the force of the spring 21. Thus, the passage 22 which communicates with the discharge line 15 of the hydraulic pump 9 is brought to communicate with the passage 23 so that the entire amount of the hydraulic fluid of the hydraulic pump 9 is relieved to the tank 16. This condition corresponds to a state indicated by the leak amount $Q_{min}$ in FIG. 5. Thus, the LS differential pressure $\Delta P_{LS}$ (pump delivery pressure) is maintained at 30 Kg/cm$^2$.

When the directional control valves 4 and 5 are switched with the intention of simultaneous driving of the hydraulic cylinder 2 and the hydraulic motor 3, the hydraulic fluid of the hydraulic pump 9 is supplied in distribution to the hydraulic cylinder 2 and the hydraulic motor 3 through the discharge line 15, the pressure compensating valves 7 and 8 and the directional control valves 4 and 5. In this case, the delivery flow rate of the hydraulic pump 9 is controlled such that a force due to the differential pressure $\Delta P_{LS}$ between the maximum load pressure $P_L$ of the actuator and the delivery pressure $P_s$ of the hydraulic pump 9, given to the flow regulating valve 12 of the regulator 10 balances with the force of the spring 14. On the other hand, since the pressure compensating valves 7 and 8 are controlled such that the differential pressures across the respective directional control valves 4 and 5 are brought to their respective setting values, that is, the differential pressure $\Delta P_{LS}$, the flow rates passing respectively through the directional control valves 4 and 5 are brought respectively to flow rates depending on the differential pressure $\Delta P_{LS}$. Thus, the hydraulic cylinder 2 and the hydraulic motor 3 can obtain their respective operational speeds in accordance with the flow rates supplied correspondingly to the opening areas of the directional control valves 4 and 5, without being influenced by load fluctuation of the other actuators. Thus, the hydraulic cylinder 2 and the hydraulic motor 3 can execute stable simultaneous driving.

During simultaneous driving as described above, the delivery pressure $P_s$ of the hydraulic pump is given to the first pressure receiving chamber 19 of the unloading valve 17, and the maximum load pressure $P_L$ of the actuator is given to the second pressure receiving chamber 20, so that the spool 18 of the unloading valve 17 operates such that the force due to the differential pressure $\Delta P_{LS}$ between the delivery pressure $P_s$ and the maximum load pressure $P_L$ balances with the force of the spring 21. At this time, the LS differential pressure $\Delta P_{LS}$ is controlled to a value of 15 Kg/cm$^2$ or less by the regulator 10. For this reason, the spool 18 of the unloading valve 17 is moved to the left in FIG. 2 and is closed so that substantially the entire amount of the hydraulic fluid from the hydraulic pump 9 is supplied to the hydraulic cylinder 2 and the hydraulic motor 3. That is, the unloading valve is in the region 26 illustrated in FIG. 5 in which the leak amount Q does not occur.

In the above simultaneous driving, when the LS differential pressure $\Delta P_{LS}$ tends to transiently exceed 15 Kg/cm$^2$ in such a case as when the control lever(s) of the directional control valve(s) 4 and/or 5 is/are abruptly returned to the neutral position/positions, the spool 18 is moved to the right in FIG. 2 so that the unloading valve 17 is opened. Thus, the delivery flow rate from the hydraulic pump 9 is partially relieved to the tank to limit the LS differential presure $\Delta P_{LS}$ below the maximum differential pressure 30 Kg/cm$^2$.

Further, when, with the intention of the minute operation of the working element, the directional control valve 4 or 5 is operated by a minute stroke within such a range that the demanded flow rate is less than the minimum delivery flow rate $Q_{min}$ of the hydraulic pump 9, a part of the minimum delivery flow rate $Q_{min}$ is supplied to the actuator so that minute-speed operation of the actuator is made possible. At this time, the remaining delivery flow rate $Q_{min}$ raises the pump delivery pressure $P_s$ and the spool 18 of the unloading valve 17 is moved in the right direction in FIG. 2 against the force of the spring 21 depending on the delivery pressure $P_s$ to relieve the remaining delivery flow rate $Q_{min}$ to the tank 16. This condition corresponds to the region in FIG. 5 in which the leak amount Q is between 0 (zero) and $Q_{min}$. Thus, the LS differential pressure $\Delta P_{LS}$ is controlled to a value within 15~30 Kg/cm$^2$ depending on the leak amount Q.

The operation peculiar to the embodiment will next be described. First, the problem of a hydraulic drive system comprising a conventional unloading valve will be described.

Figure 6:
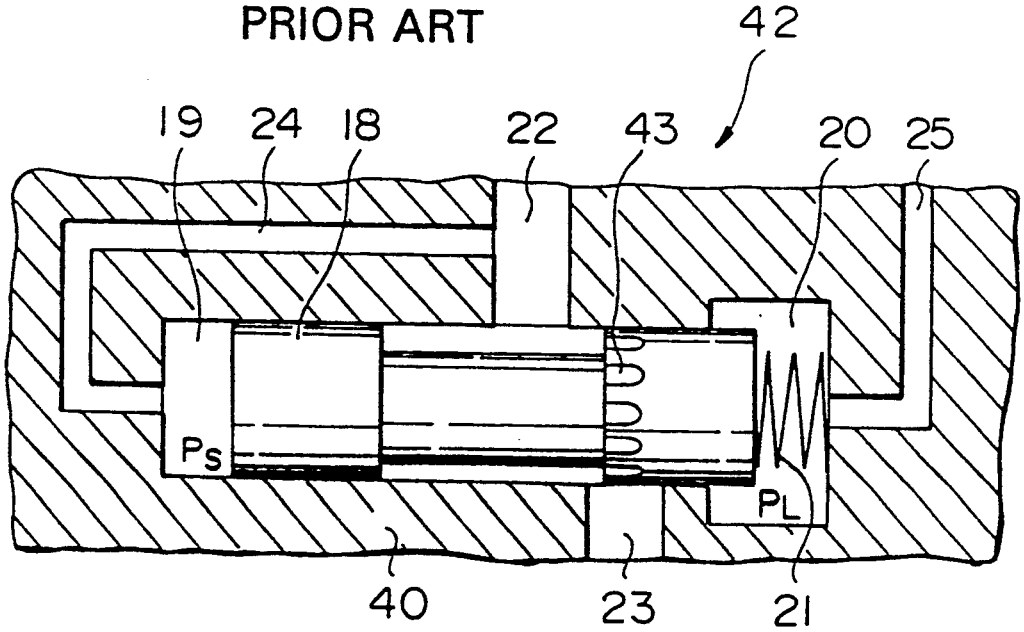
FIG.6 PRIOR ART
FIG. 6 is a cross-sectional view showing an arrangement of a conventional unloading valve.
Figure 7:
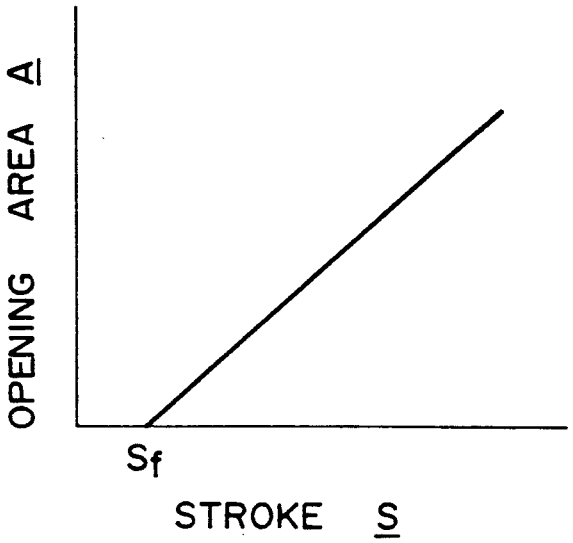
FIG. 7 is a characteristic view showing a relationship between a stroke and an opening area of the conventional unloading valve.

The conventional unloading valve is constructed as illustrated in FIG. 6. That is, a conventional unloading valve 42 does not comprise the passage 30, the restriction 31 and the passage 32 which exist in the unloading valve 17 according to the embodiment. The remaining arrangement is identical with that of the unloading valve 17 according to the embodiment. In this connection, since the passages 30 and 32 and the restriction 31 do not exist in the unloading valve 42, a relationship between the stroke S and the opening area A is linearly proportional as shown in FIG. 7, and each of the notches 43 has its corresponding configuration. The relationship between the LS differential pressure $\Delta P_{LS}$ and the stroke S and the relationship between the LS differential pressure $\Delta P_{LS}$ and the leak amount Q are identical with those of the embodiment illustrated in FIGS. 3 and 5.

In the hydraulic drive system comprising the unloading valve 42, a line between the unloading valve 42 and a pump delivery line such as line 15 in FIG. 1 and a line between the unloading valve 42 and an actuator-load-pressure takeout circuit or shuttle valve such as shuttle valve of 6 FIG. 1 are different in length from each other and, generally, the latter is longer than the former. That is, the volume of the latter is larger than that of the former. Further, the hydraulic fluid has is compressible. For this reason, when the load pressure and the pump delivery pressure vary due to the change in load acting upon the actuators 2 and 3, change in opening of the directional control valves 4 and 5, or the like, a deviation occurs in timing at which the change in the load pressure and the pump delivery pressure are transmitted to the unloading valve 42 as signal pressures. Thus, a transmission lag, that is, a phase deviation occurs between the load pressure and delivery pressure of the hydraulic pump 9.

Furthermore, as described above, when the directional control valve 4 or 5 is operated by the minute stroke, the unloading valve 42 is partially opened so that a part of the minimum delivery flow rate $Q_{min}$ of the hydraulic pump 9 is relieved to the tank, and the LS differential pressure varies depending upon the leak amount to the tank. For this reason, if the phase deviation of the signal pressures as described above occurs when the unloading valve 42 is under this condition, the change in position of the spool 18 of the unloading valve due to the phase deviation of the signal pressures and the change in the LS differential pressure due to the change in position of the spool 18 of the unloading valve interfere with each other so that oscillation occurs in the unloading valve. This oscillation is apt to occur particularly in the region 27 shown in FIG. 5.

More specifically, a condition is presumed under which the directional control valve 4 is operated by the minute stroke within the range of the minimum delivery flow rate $Q_{min}$ of the hydraulic pump 9 and the opening area thereof is maintained constant. Under this condition, if the maximum load pressure $P_L$ is raised by a minute amount from any cause, the delivery pressure $P_s$ of the hydraulic pump 9 rises together with the rise in the maximum load pressure $P_L$ since a constant flow rate from the hydraulic pump 9 tends to be passed through the directional control valve 4. The rises of the pump delivery pressure $P_s$ and the maximum load pressure $P_L$ are transmitted respectively to the first and second pressure receiving chambers 19 and 20. However, a deviation in timing, that is, the aforesaid phase deviation occurs between the pump delivery pressure $P_s$ and the maximum load pressure $P_L$. Thus, if the delivery pressure $P_s$ is given to the first pressure receiving chamber 19 of the unloading valve 42 ahead of the maximum load pressure $P_L$ given to the second pressure receiving chamber 20, the spool 18 is moved to the right as depicted in FIG. 2 to enlarge the opening area thereof, thereby increasing the leak amount Q. Accordingly, at this time, the delivery pressure $P_s$ of the hydraulic pump 9 decreases. Subsequently, however, the maximum load pressure $P_L$ is given to the spool 18 so that the spool 18 is moved to the left direction in FIG. 2 more than the necessity, that is, beyond a position to be maintained originally. Such operation or movement is repeated so that oscillation occurs. Such oscillation occurs in the case where the directional control valve 4 or 5 maintained at its neutral position is minutely operated such that the LS differential pressure $\Delta P_{LS}$ enters the region 27 illustrated in FIG. 5. Moreover, the oscillation occurs also in the case where the control lever of the respective directional control valve 4 and 5 during driving of the hydraulic cylinder 2 or the hydraulic motor 3 is returned to its neutral position such that the LS differential pressure $\Delta P_{LS}$ enters the region 27 shown in FIG. 5.

Accordingly, in the prior art, minute operation, in which the minute flow rate is supplied to the hydraulic cylinder 2 and the hydraulic motor 3 to perform an operation, is apt to become difficult. Further, even if the minute operation can be executed, oscillation of the piping system along with oscillation of the unloading valve 42 causes the control levers of the respective directional control valves 4 and 5 to oscillate. Thus, there is such a problem that an operator is liable to be tired.

The present embodiment aims to solve the above-discussed problem. That is, in the first embodiment, when with the intention of minute operation, the directional control valve 4 or 5 shown in FIG. 1 is slightly switched from the neutral position so that the control pressure (the pump delivery pressure or the maximum load pressure) varies due to the switching, if the delivery pressure $P_s$ of the hydraulic pump 9 is transmitted to the first pressure receiving chamber 19 of the spool 18 in the unloading valve 17 shown in FIG. 2 earlier than the maximum load pressure $P_L$ due to the phase deviation, the delivery pressure $P_s$ at this time is given also to the second pressure receiving chamber 20 through the passage 32, the restriction 31 and the passage 30. Thus, an actual differential pressure between the two pressure receiving chambers 19 and 20 is restrained from becoming large excessively. Subsequently, the maximum load pressure $P_L$ also rises so that the LS differential pressure $\Delta P_{LS}$ is maintained at an adequate value smaller than 30 $Kg/cm^2$ and greater than 15 $Kg/cm^2$, that is, at the differential pressure $\Delta P_{LS}$ falling in the region 27 illustrated in FIG. 5 which is put to practical use in the minute operation.

Further, also when the control lever of the directional control valve 4 or the direction control valve 5 is returned to the neutral position with the intention of minute operation from the normal driving condition of the hydraulic cylinder 2 or the hydraulic motor 3 illustrated in FIG. 1, the control pressure first reaching the spool 18 of the unloading valve 17, along with the phase deviation through the passage 32, the restriction 31 and the passage 30 is given both to the first pressure receiving chamber 19 and the second pressure receiving chamber 20 similarly to the above. Thus, occurrence of excessive differential pressure $\Delta P_{LS}$ is restrained and the LS differential pressure $\Delta P_{LS}$ is maintained in the region 27 illustrated in FIG. 5.

In this manner, in the first embodiment, a phase deviation between the delivery pressure $P_s$ and the maximum load pressure $P_L$ at the time when the directional control valves 4 and 5 are switched with the intention of minute operation is absorbed as the corresponding control pressure is given both to the first pressure receiving chamber 19 and the second pressure receiving chamber 20 through the passage 32, the restriction 31 and the passage 30. As a result, it is possible to prevent the unloading valve 17 from oscillating and, in keeping therewith, it is possible to prevent the entire system from oscillating. Thus, it is possible to improve the minute operability and to relieve fatigue of an operator along with the minute operation.

Second Embodiment

A second embodiment of the invention will be described with reference to FIG. 8. The second embodiment differs from the above-described first embodiment only in the structure of an unloading valve 17A. Otherwise, the arrangement is identical with that illustrated in FIG. 1.

Figure 8:
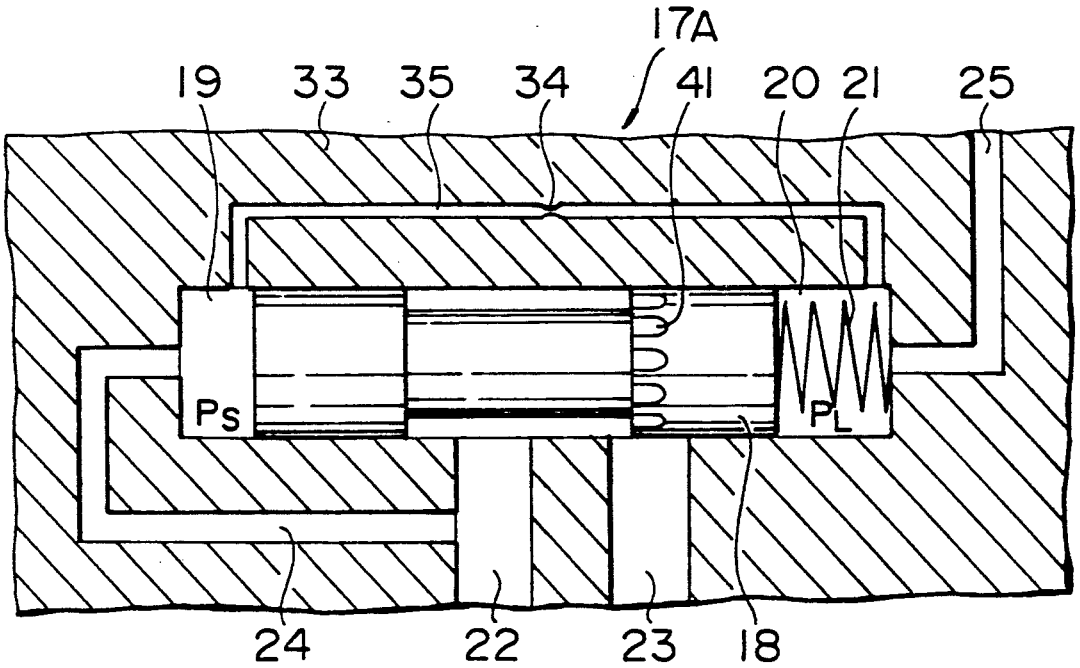
FIG. 8 is a cross-sectional view similar to FIG. 2, but showing a modification of the unloading valve according to the invention.

In FIG. 8, restrictive communication means for selectively communicating the first pressure receiving chamber 19 and the second pressure receiving chamber 20 of the unloading valve 17A with each other is formed by a passage 35 whose one end is so provided as to be communicable with the first pressure receiving chamber 19 and whose other end is so provided as to be communicable with the second pressure receiving chamber 20. Further, the passage 35 is formed in the valve housing 40 that is a body portion of the unloading valve on the outside of the spool 18. The passage 35 has a restriction 34 at a midway section. In this connection, a position of the open end of the passage 35 adjacent to the first pressure receiving chamber 19 is set such that when the spool 18 is moved to the right in FIG. 8 against the force of the spring 21 from the condition to interrupt the communication between the passage 22 and the passage 23 and prevent the leak amount Q to the tank 16 from occurring, the passage 35 opens to the first pressure receiving chamber 19 when the spool 18 is slightly moved to the right after the unloading valve 17A begins to open.

Also with the second embodiment constructed as described above, when the directional control valves 4 and 5 illustrated in FIG. 1 are slightly switched from their respective neutral positions with the intention of minute operation, or when the directional control valves 4 and 5 are returned toward their respective neutral positions from the normal driving condition of the hydraulic cylinder 2 and the hydraulic motor 3 with the intention of minute operation, a phase deviation between the delivery pressure $P_s$ and the maximum load pressure $P_L$, given to the spool 18 of the unloading valve 17A along with switching of the directional control valves 4 and 5 is absorbed as the corresponding control pressure is given both to the first pressure receiving chamber 19 and the second pressure receiving chamber 20 through the passage 35. Accordingly, there can be produced advantages of restraining oscillation of the unloading valve 17A and oscillation of the entire system in keeping therewith.

Third Embodiment

A third embodiment of the invention will be described with reference to FIGS. 9 and 10.

A hydraulic drive system according to the third embodiment comprises a hydraulic pump 9A of fixed displacement type which is driven by the prime mover 13 and which serves as the hydraulic source, hydraulic actuators, for example, hydraulic cylinder 2 and hydraulic motor 3, driven by a hydraulic fluid supplied from the hydraulic pump 9A, the directional control valve 4 for controlling a flow of the hydraulic fluid supplied from the hydraulic pump 9A to the hydraulic cylinder 2, the directional control valve 5 for controlling a flow of the hydraulic fluid supplied from the hydraulic pump 9A to the hydraulic motor 3, and the shuttle valve 6 for taking out the maximum one $P_L$ of the load pressures of the actuators.

An unloading valve 17B is arranged between a discharge line 15 of the hydraulic pump 9 and the tank 16. The unloading valve 17B has its construction substantially similar to that of the unloading valve 17 according to the first embodiment shown in FIG. 2. In this connection, description of the unloading valve 17B will hereunder be made with reference to FIG. 2.

Further, a relationship between a differential pressure between the maximum load pressure $P_L$ and the delivery pressure $P_s$, acting upon the ends of the spool 18 of the unloading valve 17B, that is, the LS differential pressure $\Delta_{LS}$ and the stroke S of the spool 18 is substantially identical with the characteristic illustrated in FIG. 3. A relationship between the stroke S of the spool 18 and its opening area A is substantially identical with the characteristic shown in FIG. 4. A relationship between the LS differential pressure $\Delta_{LS}$ of the unloading valve 17B and the leak amount Q to the tank 16 is illustrated in FIG. 10.

Figure 10:
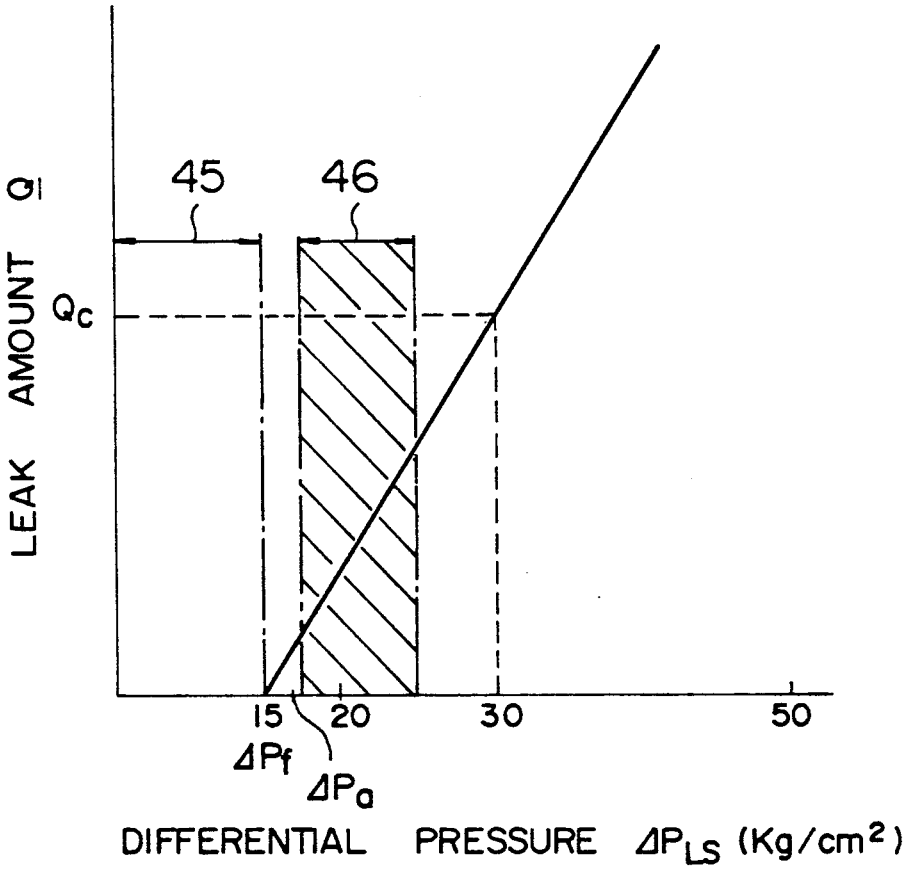
FIG. 10 is a characteristic view showing a relationship between an LS differential pressure and a leak amount of an unloading valve illustrated in FIG. 9.

In FIG. 10, a region 45 in which the leak amount Q does not occur is one in which working is performed such that the control levers of the respective directional control valves 4 and 5 are operated to their respective maximum strokes to operate the actuators at maximum speed. The reference character $Q_c$ denotes a fixed delivery flow rate of the hydraulic pump 9A. The LS differential pressure $\Delta_{LS}=30$ Kg/cm$^2$ is under such a condition that, when the control levers of the respective directional control valves 4 and 5 are in their respective neutral positions, the entire amount of the fixed delivery flow rate $Q_c$ is relieved to the tank to give the leak amount $Q=Q_c$. Further, a region 46 indicated by the oblique lines is a region in which such working is performed that the unloading valve 17B opens partially to relieve a part of the fixed delivery flow rate $Q_c$ to the tank. This region is an unstable region, similarly to the region 26 of the characteristic in FIG. 5, in which the position of the spool 18 is liable to fluctuate, so that oscillation of the unloading valve 17B is apt to occur by disturbance.

The basic or fundamental operation of the hydraulic drive system constructed as described above is as follows.

First, when the directional control valves 4 and 5 are in their respective neutral positions, the delivery pressure $P_s$ of the hydraulic pump is given to the first pressure receiving chamber 19 of the unloading valve 17B, and the maximum load pressure $P_L$ of the actuator is given to the second pressure receiving chamber 20, so that the spool 18 of the unloading valve 17B is operated such that the force due to the differential pressure $\Delta_{LS}$ between the delivery pressure $P_s$ and the maximum load pressure $P_L$ balances with the force of the spring 21. Since, however, the maximum load pressure $P_L$ is the tank pressure, the spool 18 is operated in the right direction in FIG. 2 against the force of the spring 21 depending on the delivery pressure $P_s$, and the passage 22 communicating with the discharge line 15 of the hydraulic pump 9A and the passage 23 are brought to communicate with each other. Thus, operation is performed in which the entire amount of the hydraulic fluid of the hydraulic pump 9A is relieved to the tank 16. This condition corresponds to a state indicated by the leak amount $Q_c$ in FIG. 10 under which the LS differential pressure $\Delta_{LS}$ is maintained at 30 Kg/cm$^2$ by the action of the unloading valve 17B.

When the directional control valve(s) 4 and/or 5 is/are switched with the intention of single or simultaneous driving of the hydraulic motor 3, the hydraulic fluid of the hydraulic pump 9A is supplied to the hydraulic cylinder 2 and/or the hydraulic motor 3 through the discharge line 15 and the directional control valve(s) 4 and/or 5. Also, at this time, the delivery pressure $P_s$ of the hydraulic pump is given to the first pressure receiving chamber 19 of the unloading valve 17B, and the maximum load pressure $P_L$ of the actuator is given to the second pressure receiving chamber 20, so that the spool 18 of the unloading valve 17B is operated such that the force due to the differential pressure $\Delta P_{LS}$ between the delivery pressure $P_s$ and the maximum load pressure $P_L$ balances with the force of the spring 21. If, at this time, at least one of the directional control valves 4 and 5 is operated at the maximum stroke, all of the delivery flow rate of the hydraulic pump 9A is supplied to the actuator(s) 2 and/or 3 so that the LS differential pressure $\Delta P_{LS}$ is controlled to a value equal to or less than 15 Kg/cm$^2$. For this reason, the spool 18 of the unloading valve 17B is moved to the left in FIG. 2 and is closed. This condition corresponds to the region 45 in FIG. 10 in which the leak amount Q does not occur.

On the other hand, when the control lever(s) of the directional control valve(s) 4 and/or 5 is/are in the intermediate position less than maximum stroke, operation is performed in which a part of the delivery flow rate of the hydraulic pump 9A is supplied to the actuator(s) 2 and/or 3, while the remaining flow rate is relieved to the tank 16 through the unloading valve 17B. This condition corresponds to a condition in FIG. 10 under which the LS differential pressure is larger than $\Delta P_f$, and the LS differential pressure fluctuates within a range of from 15 Kg/cm$^2$ to 30 Kg/cm$^2$ in accordance with the amount of supply of the hydraulic fluid to the actuator(s) 2 and/or 3. This region 46 is an unstable region as described above. Since a delay in transmittance, that is, a phase deviation occurs between the control pressures given to the unloading valve as signal pressure, that is, between the delivery pressure $P_s$ of the hydraulic pump and the maximum load pressure $P_L$, due to the volume of the lines constituting the circuit and compressibility of the hydraulic fluid, oscillation is liable to occur in the conventional unloading valve.

The embodiment is developed to solve the above-discussed problems. That is, in the third embodiment, when, for example, the directional control valves 4 and 5 illustrated in FIG. 9 are switched from their respective neutral positions to their respective intermediate stroke positions so that the control pressure (pump delivery pressure or the maximum load pressure) varies due to the switching, if the delivery pressure $P_s$ of the hydraulic pump 9A is transmitted to the first pressure receiving chamber 19 of the spool 18 of the unloading valve 17 shown in FIG. 2 earlier than the maximum load pressure $P_L$ due to the phase deviation, the delivery pressure $P_s$ at this time is given also to the second pressure receiving chamber 20 through the passage 32, the restriction 31 and the passage 30. Thus, the differential pressure $\Delta P_{LS}$ between the delivery pressure $P_s$ and the maximum load pressure $P_L$ is restrained from becoming excessively large. Then, the maximum load pressure $P_L$ also rises so that the LS differential pressure $\Delta P_{LS}$ is maintained by the restriction 31 at an adequate value smaller than 30 Kg/cm$^2$ and larger than 15 Kg/cm$^2$, that is, at the differential pressure $\Delta P_{LS}$ corresponding to the region 46 illustrated in FIG. 10.

Figure 9:
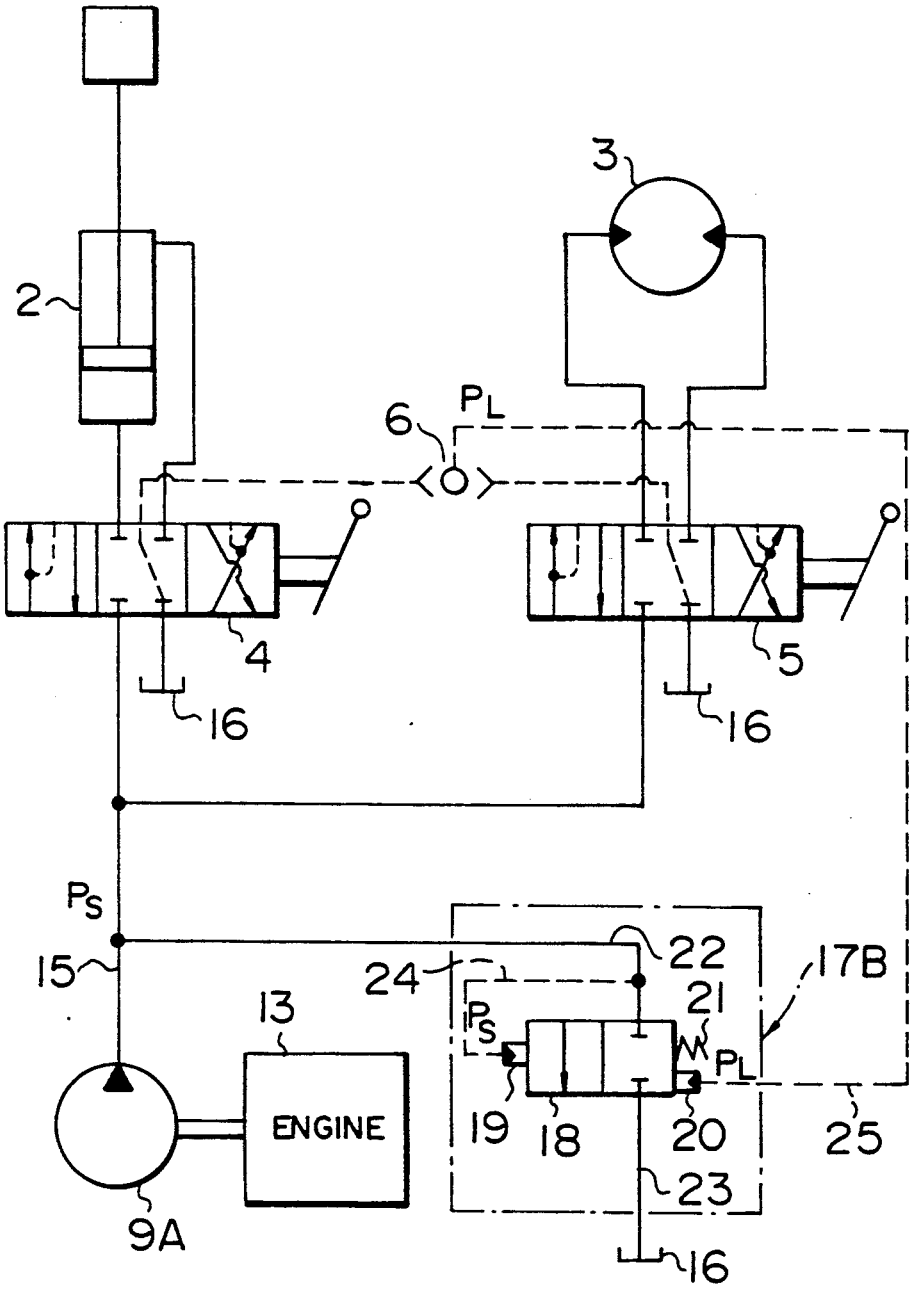
FIG. 9 is a schematic view showing a circuit arrangement of a hydraulic drive system for a civil-engineering and construction machine, according to another embodiment of the invention.

Also when the control lever of the directional control valve 4 or the directional control valve 5 is returned to the intermediate position from the driving condition of the hydraulic cylinder 2 or the hydraulic motor 3 under which the directional control valves 4 and 5 shown in FIG. 9 operate at their respective maximum stroke positions, the control pressure first reaching the spool 18 of the unloading valve 17B due to the phase deviation is given both to the first pressure receiving chamber 19 and the second pressure receiving chamber 20 through the passage 32, the restriction 31 and the passage 30 similarly to the above. Thus, occurrence of the excessive differential pressure $\Delta P_{LS}$ can be restrained so that the LS differential pressure $\Delta P_{LS}$ is maintained in the region 46 illustrated in FIG. 10.

In this manner, in the third embodiment, the deviation in phase between the delivery pressure $P_s$ and the maximum load pressure $P_L$ at the time when the directional control valves 4 and 5 are switched to their respective intermediate stroke positions is absorbed as the corresponding control pressure is given both to the first pressure receiving chamber 19 and the second pressure receiving chamber 20 through the passage 32, the restriction 31 and the passage 30. As a result, oscillation of the unloading valve 17B can be prevented and further oscillation of the entire system can be prevented. Thus, it is possible to improve the operability and to relieve fatigue of an operator.

Since the hydraulic drive system for the civil-engineering and construction machine according to the invention is constructed as described above, it is possible to prevent oscillation due to the phase deviation between the maximum load pressure $P_L$ and the delivery pressure $P_s$ of the hydraulic pump transmitted to the unloading valve as signal pressure. Thus, it is possible to improve operability and to relieve fatigue of the operator in keeping with the operation, as compared with the conventional hydraulic drive system.

What is claimed is:

1. A hydraulic drive system for a civil-engineering and construction machine, comprising a hydraulic source including a hydraulic pump, a hydraulic actuator driven by a hydraulic fluid supplied from said hydraulic source, a directional control valve for controlling a flow of the hydraulic fluid supplied from said hydraulic source to said hydraulic actuator, and an unloading valve connected to a discharge line of said hydraulic pump for relieving the hydraulic fluid from said hydraulic pump to a tank when a differential pressure between a delivery pressure of said hydraulic pump and a load pressure of said actuator exceeds a first predetermined value, for controlling said differential pressure, said unloading valve having a spool, a first pressure receiving chamber arranged adjacent to a first end of said spool, and a second pressure receiving chamber arranged adjacent to a second end of said spool, the delivery pressure of said hydraulic pump being introduced into said first pressure receiving chamber, and the load pressure of said hydraulic actuator being introduced into said second pressure receiving chamber so that said spool is driven toward one of said ends to open or close said unloading valve in accordance with said differential pressure, wherein said unloading valve includes restrictive communication means for communicating said first pressure receiving chamber and said second pressure receiving chamber with each other only when said spool is in a predetermined stroke range between said first and second ends at which said unloading valve is at least partially open.

2. A hydraulic drive system for a civil-engineering and construction machine, according to claim 1, wherein said restrictive communication means is formed to communicate said first pressure receiving chamber and said second pressure receiving chamber with each other when said differential pressure exceeds a second predetermined value larger than said first predetermined value.

3. A hydraulic drive system for a civil-engineering and construction machine according to claim 2, wherein said restrictive communication means is provided within said spool.

4. A hydraulic drive system for a civil-engineering and construction machine according to claim 2, wherein said restrictive communication means is provided in a housing forming a body of said unloading valve.

5. A hydraulic drive system for a civil-engineering and construction machine, according to claim 1, wherein said restrictive communication means includes a passage through which said first pressure receiving chamber and said second pressure receiving chamber communicate with each other, and a restriction provided in said passage.

6. A hydraulic drive system for a civil-engineering and construction machine according to claim 5, wherein said restrictive communication means is provided within said spool.

7. A hydraulic drive system for a civil-engineering and construction machine according to claim 5, wherein said restrictive communication means is provided in a housing forming a body of said unloading valve.

8. A hydraulic drive system for a civil-engineering and construction machine, according to claim 1, wherein said restrictive communication means is provided within said spool.

9. A hydraulic drive system for a civil-engineering and construction machine, according to claim 1, wherein said restrictive communication means is provided in a housing forming a body of said unloading valve.

10. A hydraulic drive system for a civil-engineering and construction machine, according to claim 1, in which said hydraulic pump is of a variable displacement type, and in which said hydraulic source includes a regulator for controlling a delivery flow rate of said hydraulic pump such that a differential pressure between the delivery pressure of said hydraulic pump and a load pressure is maintained at a third predetermined value, wherein said restrictive communication means is formed to communicate said first pressure receiving chamber and said second pressure receiving chamber with each other when said differential pressure exceeds a fourth predetermined value larger than said first and second predetermined values.

11. A hydraulic drive system for a civil-engineering and construction machine, according to claim 10, wherein said restrictive communication means is provided within said spool.

12. A hydraulic drive system for a civil-engineering and construction machine according to claim 10, wherein said restrictive communication means is provided in a housing forming a body of said unloading valve.

13. An unloading valve for use in a hydraulic drive system for a civil-engineering and construction machine, said hydraulic drive system comprising a hydraulic actuator driven by a hydraulic fluid supplied from said hydraulic source, and a directional control valve for controlling a flow of the hydraulic fluid supplied from said hydraulic source to said hydraulic actuator, said unloading valve being connected to a discharge line of said hydraulic pump for relieving the hydraulic fluid from said hydraulic pump to a tank when a differential pressure between the delivery pressure of said hydraulic pump and the load pressure of said actuator exceeds a first predetermined value, for controlling said differential pressure, said unloading valve having a spool, a first pressure receiving chamber arranged adjacent to a first end of said spool, and a second pressure receiving chamber arranged adjacent to a second end of said spool, the delivery pressure being introduced into said first pressure receiving chamber, and the load pressure of said hydraulic actuator being introduced into said second pressure receiving chamber so that said spool is driven toward one of said ends to open or close said unloading valve in accordance with said differential pressure, wherein said unloading valve comprises:

restrictive communication means for communicating said first pressure receiving chamber and said second pressure receiving chamber with each other only when said spool is in a predetermined stroke range between said first and second ends at which said unloading valve is at least partially open.

14. An unloading valve according to claim 13, wherein said restrictive communication means is formed to communicate said first pressure receiving chamber and said second pressure receiving chamber with each other when said differential pressure exceeds a second predetermined value larger than said first predetermined value.

15. An unloading valve according to claim 14, wherein said restrictive communication means is provided within said spool.

16. An unloading valve according to claim 14, wherein said restrictive communication means is provided in a housing forming a body of said unloading valve.

17. An unloading valve according to claim 13, wherein said restrictive communication means includes a passage through which said first pressure receiving chamber and said second pressure receiving chamber communicate with each other, and a restriction provided in said passage.

18. An unloading valve according to claim 17, wherein said restrictive communication means is provided within said spool.

19. An unloading valve according to claim 17, wherein said restrictive communication means is provided in a housing forming a body of said unloading valve.

20. An unloading valve according to claim 13, wherein said restrictive communication means is provided within said spool.

21. An unloading valve according to claim 13, wherein said restrictive communication means is provided in a housing forming a body of said unloading valve.

* * * * *